US008362378B2

(12) United States Patent
Wong et al.

(10) Patent No.: US 8,362,378 B2
(45) Date of Patent: Jan. 29, 2013

(54) ELECTRICAL SWITCH

(76) Inventors: Memie Mei Mei Wong, Hong Kong (CN); Sam Yun Sum Wong, Hong Kong (CN)

( * ) Notice: Subject to any disclaimer, the term of this patent is extended or adjusted under 35 U.S.C. 154(b) by 273 days.

(21) Appl. No.: 12/782,971

(22) Filed: May 19, 2010

(65) Prior Publication Data

US 2011/0284350 A1 Nov. 24, 2011

(51) Int. Cl.
*H01H 3/00* (2006.01)

(52) U.S. Cl. ..... 200/329

(58) Field of Classification Search ..... 200/329, 200/543, 537, 411, 413, 418, 419–421, 423
See application file for complete search history.

(56) References Cited

U.S. PATENT DOCUMENTS 2,054,502 A * 9/1936 Hallett ..... 200/33 R
2,103,986 A * 12/1937 Johnson ..... 200/420
2,295,713 A * 9/1942 Buckley ..... 315/99
2,350,967 A * 6/1944 Nunes ..... 200/5 F
2,389,075 A * 11/1945 Nunes ..... 200/423
2,523,077 A * 9/1950 Unterschuetz et al. ..... 200/423
2,629,789 A * 2/1953 Benander ..... 200/51.15

* cited by examiner

*Primary Examiner* — Edwin A. Leon
(74) *Attorney, Agent, or Firm* — Leydig, Voit & Mayer, Ltd.

(57) ABSTRACT

An electrical switch has a casing, fixed and moving contacts, and an internal operator turning and moving the moving contact relative to the fixed contact for switching. The casing has an opening through which an engagement part of the operator is accessible from outside for engaging a pull chain to turn the operator. The casing has a tubular part by which the switch may be mounted and through which the pull chain extends. The tubular part, being molded, has an inner surface defining a passage for the pull chain, an outer surface bearing a screw thread for engagement by a threaded nut, and, in a transverse cross-section, four recesses between the inner and outer surfaces to alleviate deformation of the screw thread due to shrinkage in molding.

21 Claims, 4 Drawing Sheets

ELECTRICAL SWITCH

BACKGROUND OF THE INVENTION

Electrical switches of the kind concerned are sometimes known as rotary stepping switches, which in a typical construction include a casing, two or more fixed contacts and a moving contact in the casing, and an internal operator rotatable by means of a pull chain to turn the moving contact into or out contact with the fixed contacts for switching. As the pull chain is connected during assembly of the switch, change is usually not possible.

The pull chain extends out through a tubular part of the casing, which is externally screw-threaded for tightening by a screw nut upon an electrical appliance using the switch. The outer and inner diameters of the tubular part are subject to constraints, in that the outer diameter is usually fixed and the inner diameter should not be too large so as to avoid kinking of the pull chain in the tubular part.

The invention seeks to mitigate or at least alleviate at least one of the aforesaid problems or shortcoming by providing an improved or otherwise new electrical switch of the type concerned.

SUMMARY OF THE INVENTION

According to a first aspect of the invention, there is provided an electrical switch comprising a casing, at least one fixed contact and at least one moving contact in the casing, and an operator supported internally of the casing for movement to move the moving contact into or out contact with the fixed contact for switching, the operator having an engagement part. The casing has an opening through which the engagement part of the operator is accessible from outside the casing for engagement of an external elongate pliable member which is then used upon pulling to operate the operator to move the moving contact for switching.

Preferably, the engagement part has a slot for engaging immediately behind an enlarged part of a said pliable member to connect a said pliable member, the slot having an open end via which a said pliable member is laterally engageable into the slot and a closed end for engaging a said pliable member.

More preferably, the engagement part has a recess at the closed end of the slot for retaining the enlarged part of a said pliable member in engagement with the slot.

More preferably, the operator is supported for angular movement about an axis, and the slot is provided on one side of the engagement part facing in a direction parallel to the axis.

More preferably, the operator is supported for angular movement on an imaginary plane, and the slot is provided on one side of the engagement part facing away from the imaginary plane.

In a preferred embodiment, the casing includes a closure member for closing the opening after a said pliable member has been connected to the engagement part.

More preferably, the closure member is securable upon the opening through snap connection with the casing.

More preferably, the closure member includes a peripheral side wall for at least partially surrounding a part of the casing as it closes the opening.

Further more preferably, the closure member has a generally flat wall from which the peripheral side wall extends, the flat wall having an outer surface bearing data relating to the switch.

It is preferred that the casing has first and second parts interconnected to form the casing with the opening in the second part, and includes a third part disposable upon and covering the second part to close the opening.

It is further preferred that the second and third parts of the casing have a comparable size and complementary shape for inter-engagement.

It is preferred that the casing has a tubular part through which a said pliable member connected with the engagement part extends out of the casing for pulling to operate the operator and by which the electrical switch may be mounted.

According to a second aspect of the invention, there is provided an electrical switch comprising a casing, at least one fixed contact and at least one moving contact in the casing, an operator supported in the casing for movement to move the moving contact into or out of contact with the fixed contact for switching, and an elongate pliable member associated with the operator for pulling to operate the operator. The casing has a protruding tubular part by which the electrical switch may be mounted and through which a said pliable member associated with the engagement part extends out of the casing for pulling to operate the operator. The tubular part, being made of a moldable material, has an inner surface defining a passage for a said pliable member, an outer surface bearing a screw thread for screw engagement by a screw-threaded nut member, and in a transverse cross-section at least one void space between the inner surface and the outer surface, thereby alleviating deformation of the screw thread due to mold shrinkage of the tubular part.

Preferably, the tubular part has a wall thickness between the inner surface and the outer surface, the wall thickness being increased by presence of said at least one void space without increasing the amount of the moldable material used in making of the tubular part.

Preferably, the tubular part has a plurality of said void spaces disposed around the passage.

More preferably, the void spaces are of equal shape and size and are disposed evenly around the passage.

It is preferred that said at least one void space opens at the outer surface and thereby interrupts the screw thread.

It is further preferred that said at least one void space falls short of the inner surface, whereby the inner surface is intact.

It is further preferred that the tubular part has a plurality of said void spaces disposed around the passage, the void spaces extending lengthwise of the tubular part to form a row of teeth on the outer surface between each pair of adjacent void spaces, the teeth across the rows constituting the screw thread that is interrupted.

It is yet further preferred that the void spaces and the rows of teeth extend axially along the tubular part.

In a preferred embodiment, the tubular part has an integral outer end of a trumpet-shaped inner profile to provide a smooth bearing for a said pliable member extending out of the passage.

BRIEF DESCRIPTION OF DRAWINGS

The invention will now be more particularly described, by way of example only, with reference to the accompanying drawings, in which.

DETAILED DESCRIPTION OF THE INVENTION

Figure 1:
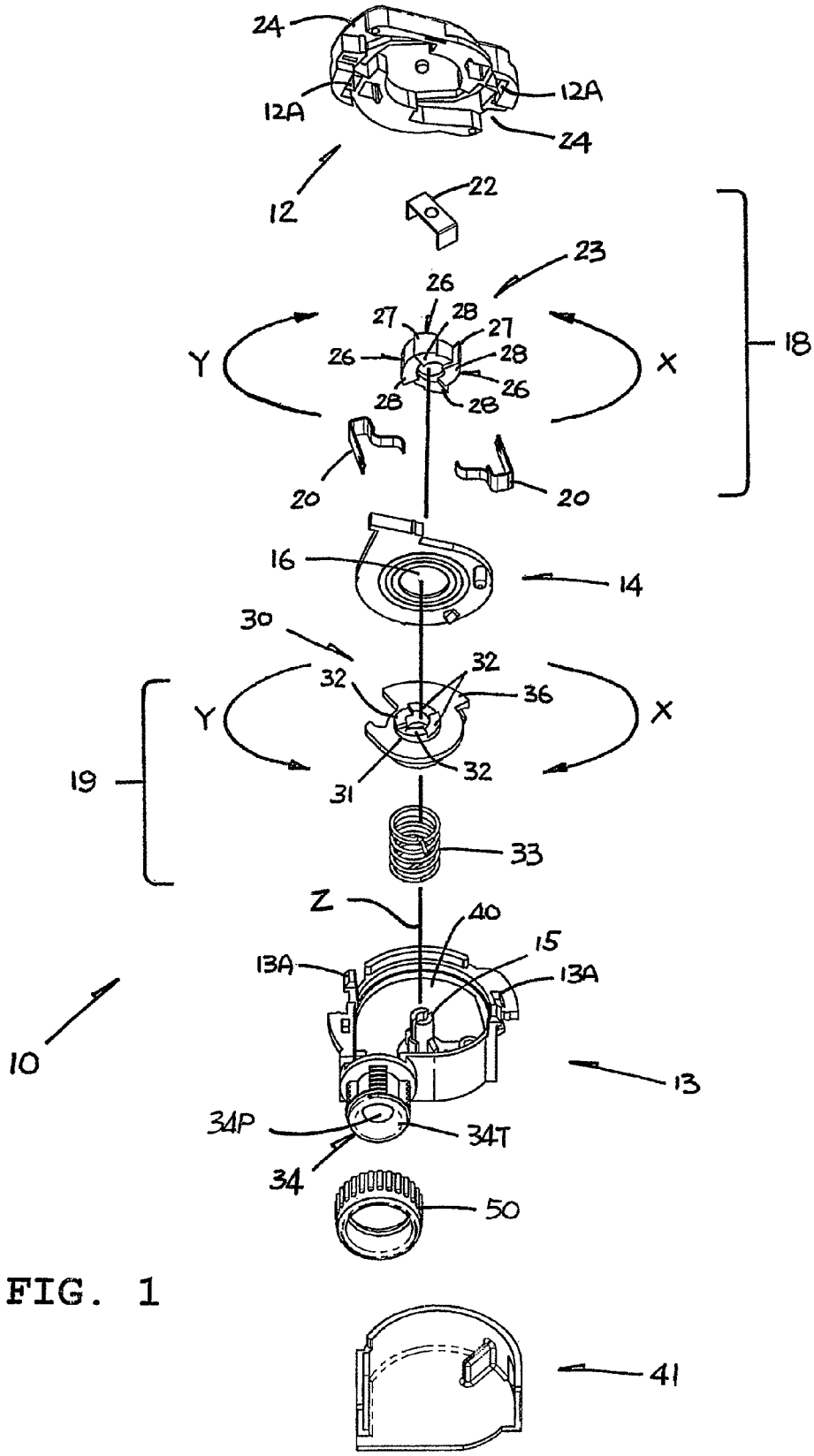
FIG. 1 is an exploded perspective view of an embodiment of an electrical switch in accordance with the invention, which is operated by a pull chain.
Figure 2:
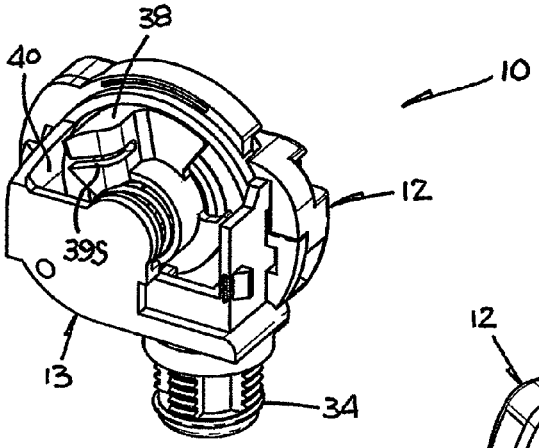
FIG. 2 is a perspective view of the electrical switch of FIG. 1, assembled except as to the pull chain.

Referring to the drawings, there is shown an electrical switch embodying the invention, which takes the form of a rotary stepping switch 10 operated by means of a beaded metal pull chain 37 or a string or any suitable elongate pliable member, also commonly known as a pull-chain switch. The electrical switch 10 has a construction that is generally known in the art, with the exception of certain aspects relating to, in particular, the installation of the pull chain 37 and the part with which the switch 10 is mounted and through which the pull chain 37 extends out as described further down below.

Meanwhile a typical construction of the electrical switch 10 is described with reference to FIG. 1. The switch 10 has a plastic body or casing formed by an upper and lower casing part 12 and 13 with a flat partition 14 between them. A vertical central shaft 15 extends from the lower casing part 13 to the upper casing part 12 through the partition 14 via a central hole 16 thereof. The two casing parts 12 and 13 are secured together through snap-fit engagement between a pair of hooks 13A projecting from the lower casing part 13 and respective holes 12A of the upper casing part 12 into which the hooks 13A are snap-fitted.

The lower casing part 13 has, protruding from one side thereof, an externally screw-threaded tube 34 which acts as a bolt by which the overall switch 10 may be mounted on a wall in an electrical appliance such as an electrical ceiling fan, with the use of a screw nut 50 as is generally known in the art. The tube 34 also defines a tubular aperture or passage 34P through which the chain 37 extends out of the body of the switch 10 for pulling.

The electrical switch 10 typically incorporates a switch mechanism 18 in the upper casing part 12 and an operating mechanism 19 in the lower casing part 13. The operating mechanism 19 is turned upon pulling of the pull chain 37 by a user to operate the switch mechanism 18 i.e. changing its switching condition. The operating mechanism 19 will self-return upon release of the chain 37 without resetting the switching condition of the switch mechanism 18.

The switch mechanism 18 is formed by a pair of fixed contacts 20 located within opposite ends of the upper casing part 12 and by a moving contact 22 mounted on a generally cylindrical rotor 23 which forms part of the switch mechanism 18. The rotor 23 is disposed co-axially on the central shaft 15 for rotation thereabout, being flanked by the fixed contacts 20.

Each fixed contact 20 is provided by a bent copper strip. A hole 24 at each end of the upper casing part 12 permits insertion of the end of an electrical cable for connection to the corresponding fixed contact 20. The fixed contact 20 has a self-gripping end which is arranged to clamp an inserted end of the cable against an adjacent wall in the hole 24, thereby automatically connecting the cable upon insertion.

The moving contact 22 is provided by an inverted broad U-shaped copper strip which is located on and extends across the upper end of the rotor 23 for short-circuiting the two fixed contacts 20 at opposite ends to close the electrical switch 10, or breaking the circuit between the fixed contacts 20 to open the switch 10.

The lower end of the rotor 23 is divided into four 90° sectors or quadrants 26, each of which gradually expands radially outwards as well as axially downwards in direction X to form a first ring of four asymmetrical radial teeth 27 and a second ring of four asymmetrical axial teeth 28. The radial teeth 27 interact with the fixed contacts 20 (which are themselves resiliently deformable) through a ratchet action to stop reverse turning of the rotor 23 (i.e. against resetting the switching condition of the switch mechanism 18) when the operating mechanism 19 self-returns. A one-way clutch is thus formed between the rotor 23 and the fixed contacts 20 for action during return of the rotor 23.

The operating mechanism 19 further includes an internal rotationally reciprocating disc-like operator 30, which is also disposed co-axially on the shaft 15 for turning thereabout as the rotor 23. The shaft 15 establishes a central axis Z of the electrical switch 10, about which the operator 30 and the rotor 23 are angularly movable or to turn.

A central collar 31 on the operator 30 is divided into four quadrants each of which gradually slopes upwards in direction Y, together forming a ring of four asymmetrical teeth 32 facing the rotor 23 from below.

The operator 30 engages axially with the rotor 23, with their teeth 32 and 28 being complementary to and in mesh with each other through the hole 16 of the partition 14. By reason of their asymmetrical profiles, the teeth 28 and 32 interact through a ratchet action such that their inter-engagement will hold when the operator 30 turns in direction Y thereby advancing the rotor 23 and will slip upon return of the operator 30 in the opposite direction X thereby leaving the rotor 23 stay put angularly.

A coil spring 33 in the lower casing part 13 urges the operator 30 axially from below against the rotor 23 for holding their inter-engagement, and the spring 33 recedes to allow return of the operator 30 without bringing the rotor 23. Another one-way clutch is thus formed between the operator 30 and the rotor 23 for action during advancing of the rotor 23. The spring 33 also resiliently biases the operator 30 in direction X such that the operator 30 is capable of self-returning, upon release of the pull chain 37, to prepare for the next switching operation.

The operator 30 has a nose 36 protruding from one side of its periphery, to which an inner end of the pull chain 37 should be connected for, upon pulling, advancing the operator 30. In this regard, the nose 36 has a connector 38 for connecting the beaded chain 37 by a first bead 37A at its inner end.

In a different design where a nylon string is used as the pliable elongate member, the string may be moulded with a series of plastic beads to simulate a beaded metal chain, or with only one plastic bead or tied into a knot as an enlarged part at its inner end for engagement with the connector 38.

As is generally known in the art, all the internal components mentioned above should be installed before the two casing parts are closed and secured together using the snap-fit connectors 13A and 12A as described, or otherwise ultrasonic welding or metal rivets for example. Once the casing parts are closed, they cannot be taken apart without damage, and therefore repair or change ex-factory are normally neither possible nor intended to ensure integrity of the switch construction. Such a feature is present in all pre-existing pull-chain switches generally stated.

As mentioned earlier, one aspect of the present invention is concerned with the installation of the pull chain 37, or in general the pliable elongate member which is available in different materials, colours and designs to meet different customers' needs. For example, copper, brass, steel, thread materials (i.e. strings) and plastic materials may be used, and moreover they may be tinted in different colours or electroplated/coated to provide various surface textures. Different constructions other than beaded are also possible. There are unlimited alternatives for or variations in the design of the elongate pliable member or pull chain generally stated.

In all pre-existing pull-chain switches in general, the pull chain must be installed before the casing parts are closed and secured together. A wide range in the design of the pull chain to meet various customers' needs will therefore require a very substantial stock or inventory, otherwise supply will be limited in terms of designs or restricted in terms of supply quantity and/or speed if electrical switches with the wanted chains are manufactured on demand.

The electrical switch 10 of the described embodiment has been modified such that it permits installation of the pull chain 37 after the casing parts 12 and 13 have been closed with all of the other internal components already put in place inside, i.e. assembly of the switch 10 has already been completed for all practical purposes.

In this regard, the lower casing part 13 is formed with an opening 40 which exposes the connector 38 and through which the connector 38 is accessible from outside the casing 12/13 for the connection of an external pull chain 37 at a later stage, after a specific design of the pull chain 37 (in terms of construction, material, colour and/or length for example) has been chosen by a customer.

The opening 40 is formed by omission of material from the lower casing part 13, which otherwise forms part of the base and peripheral wall of the casing part 13. The opening 40 has an arcuate shape and it preferably extends over about three quarters of the periphery of the casing part 13 from one end where it fully exposes the connector 38 to the other end just about reaching an inner end of the tubular passage 34P.

There is a separate plastic closure cover 41 (FIG. 5) for covering and hence sealing off the opening 40. The cover 41 is shell-like and is formed by a flat front wall 41A and a U-shaped (inverted as shown) peripheral side wall 41B which extends from and partially along the edge of the front wall 41A. The cover's walls 41A and 41B are shaped and sized to match with the base and peripheral wall of the casing part 13 for fitting over the same, with the side wall 41B partially surrounding the lower casing part 13, thereby completely closing the opening 40 and in particular covering the connection between the chain 37 and the connector 38.

On each of the left and right sides of the electrical switch 10, a hole 41C in the cover 41 and a hook 13C on the casing part 13 inter-engage to secure the cover 41 onto the casing part 13 through snap-fit connection. The cover 41 is not intended to be detachable once secured, though it can be ripped off (and probably damaged) if necessary to enable changing or replacement of the pull chain 37.

Being located on the periphery of the operator 30, the connector 38 is angularly movable, upon turning of the operator 30 in opposite directions, towards and away from the inner end of the tubular passage 34P.

The connector 38 is a knob lying underneath the nose 36, having an internal oblong cavity 39. The cavity 39 has an open end at a first end 38A of the connector 38 facing away from the inner end of the passage 34P and an opposite closed end at a second end 38B of the connector 38 closer to the said aperture's inner end. The connector 38 includes an outer slot 39S which runs right from the open end of the cavity 39 and turns to extend across the cavity's closed end. The slot 39S merges with the cavity 39 such that the cavity's interior is accessible laterally through the slot 39S, other than via the open end.

More specifically, the slot 39S is provided on one side of the connector 38 facing in a direction parallel to the axis Z or, in other words, facing away from an imaginary plane on which the operator 30 turns.

Figure 3:
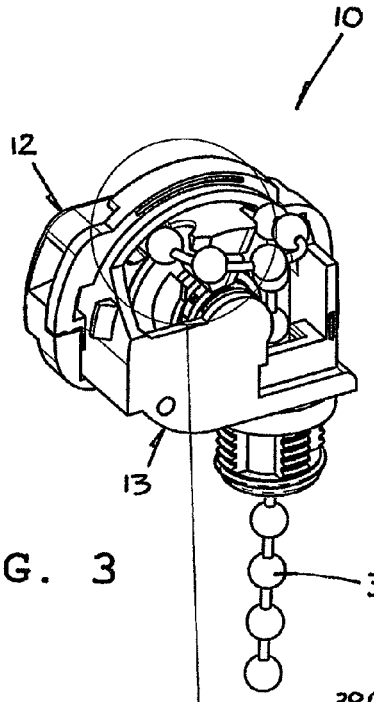
FIG. 3 is a perspective view similar to FIG. 2, showing how the pull chain is connected to an internal connector of the electrical switch.
Figure 3A:
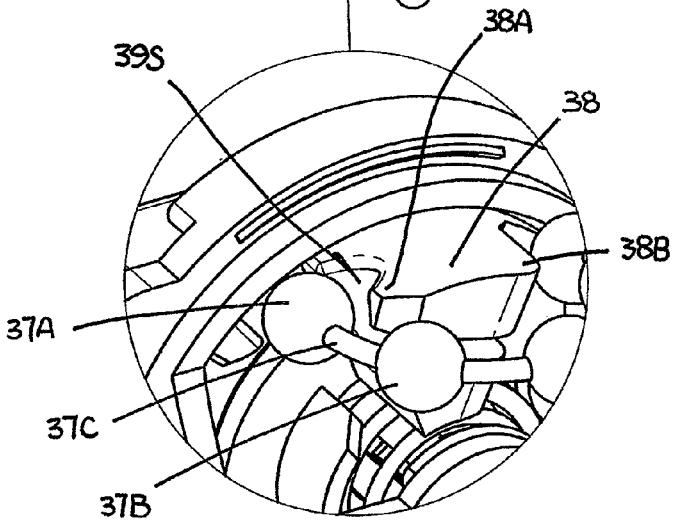
FIG. 3A is an enlarged perspective view of a part of the electrical switch of FIG. 3, showing the pull chain being connected to the connector.
Figure 4:
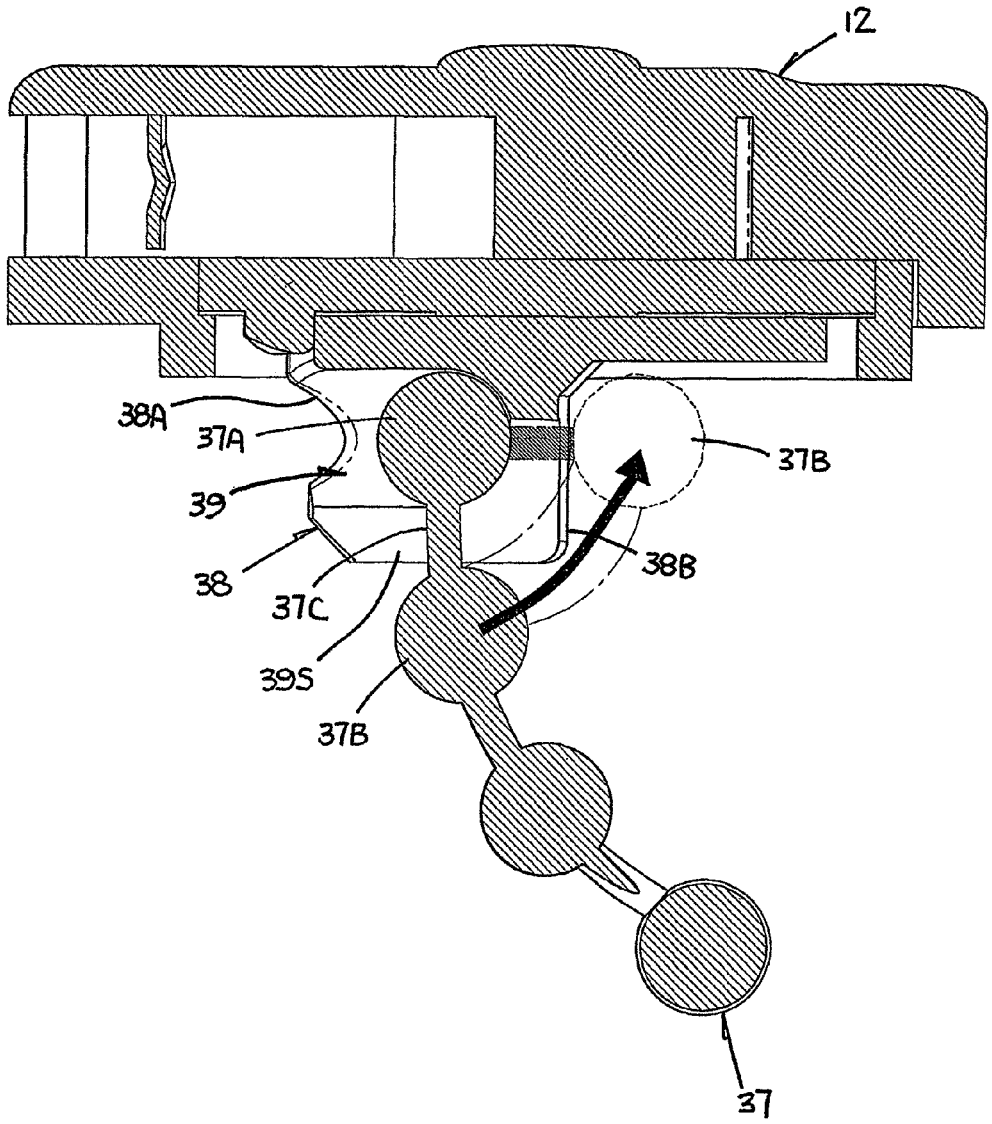
FIG. 4 is a schematic cross-sectional side view of the electrical switch of FIG. 3, showing the pull chain being connected to the connector.

To connect with the connector 38, the pull chain 37 is first inserted with its first bead 37A into the cavity 39 via the cavity's open end (see FIGS. 3 and 3A). Subsequent engagement of a link 37C between the first bead 37A and a second bead 37B laterally into the slot 39S from its open end right down to its closed end then completes the connection (see dashed lines in FIG. 4). En route the second bead 37B turns snugly round an outer corner at the second end 38B of the connector 38, and this helps holding the second bead 37B at the connector's second end 38B and hence the relevant end of the chain 37 connected with the connector 38.

The first bead 37A is held captive in the cavity 39 with the link 37C engaging through the slot 39S, such that the slot 39S engages with its closed end immediately behind the much wider first bead 37A to thereby establish the connection of the pull chain 37.

Figure 5:
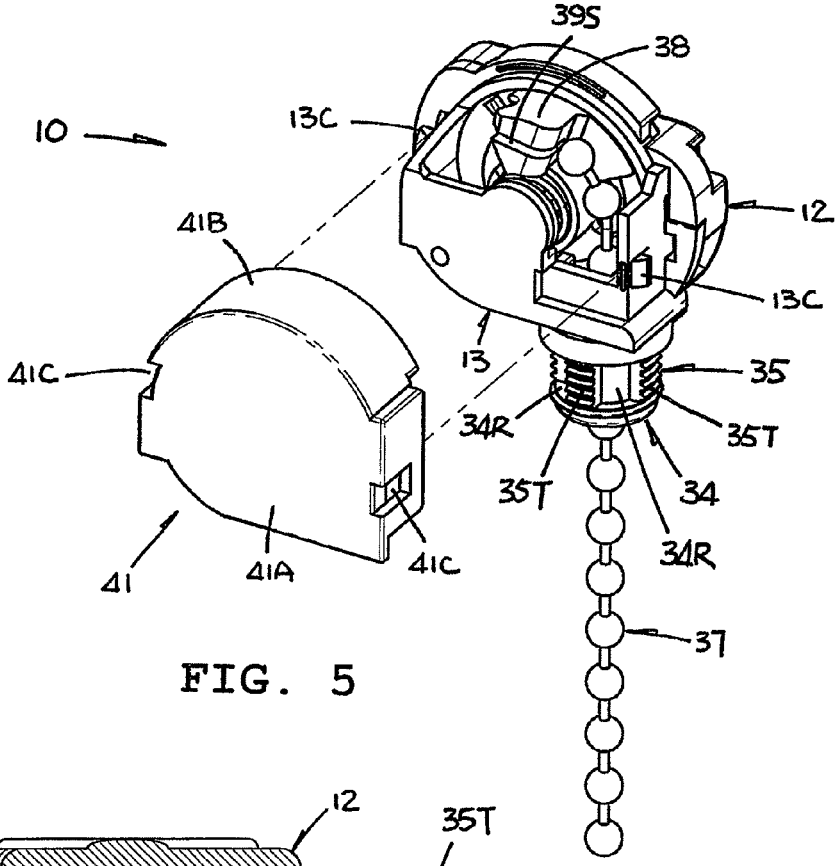
FIG. 5 is a perspective view subsequent to FIG. 3, showing how a cover is fitted over the body of the electrical switch after the pull chain has been connected.

The other free end of the pull chain 37 is threaded through the tube 34 via the inner end of its passage 34P (FIG. 3) until the chain 37 extends out of the switch casing 11 for as much as its length permits (FIG. 5). Finally, the cover 41 is snap-fitted over the lower casing part 13 to seal off the opening 40 (FIG. 5). The cover 41 lies with its flat wall 41A close to upon and alongside the slot 39S, thereby preventing dislocation/detachment of the connected end of the chain 37 from the connector 38.

The cover 41 may be considered as a third part of the switch casing, which has a comparable size and complementary shape as the lower casing part 13 for inter-engagement therewith to render the switch casing complete.

The flat wall 41A of the cover 41 is readily available and is suitable for printing or marking of data relating to the electrical switch 10, such as the manufacturer's name, trade mark, model number and/or safety standard mark.

Another aspect of the invention lies in the configuration of the tube 34 with which the electrical switch 10 is mounted for operation and through which the pull chain 37 extends.

Both casing parts 12 and 13 are made of moldable plastics material and are molded to shape, and so is the tube 34 that being an integral part of the lower casing part 13. The tube 34 has an inner surface which defines the passage 34P for the pull chain 37, and an outer surface which bears a multiple-turn helical screw thread 35 for screwing engagement by the screw nut 50. The screw nut 50 is to be tightened on the outside of the ceiling fan in which the electrical switch 10 is used, and is usually made of metal or metal alloy such as copper for matching with the design of the fan.

The tube 34 is molded to include four distinct recesses 34R in its outer surface, which are disposed evenly around the passage 34P and extend axially along substantially the entire length of the tube 34. The recesses 34R are of equal shape and size. Each of the recesses 34R is an example of a void space in a transverse cross-section of the tube 34, between the inner surface and the outer surface thereof. Each recess 34R opens at the outer surface and hence interrupts or breaks the continuity of the screw thread 35.

Four rows of teeth 35T are formed on the outer surface by the recesses 34R, with each row extending axially along the tube 34 between each pair of adjacent recesses 34R. The teeth 35T across the rows are aligned to constitute the screw thread 35 that is interrupted.

Bottoms of the recesses 34R fall short of the inner surface of the tube 34, whereby the inner surface are intact, as opposed to the outer surface being recessed.

The tube 34 has a standard outer diameter of typically about 9 mm for fitting through a standard hole of about 10 mm diameter in the wall of a ceiling fan of the type concerned and/or for the screw nut 50 of a standard size to fit on. More specifically, the screw nut 50 has a specific inner diameter and screw pitch, etc. as sort of industrial standards for interchangeability between different designs or materials, with which the tube 34 of the electrical switch 10 must match.

The passage 34P through the tube 34 should have an optimal inner diameter of about 3 mm to fit the pull chain 37. In particular, the passage 34P should not be too wide so as to avoid the pull chain 37 kinking in the passage 34P or, in general, forming a short tight twist or curl caused by a doubling or winding of the chain 37 upon itself.

With a standard outer diameter of 9 mm and an optimal inner diameter of 3 mm as described above, the tube 34 has a cylindrical wall whose thickness is 3 mm. The wall in this particular embodiment cannot be made much thinner without compromising i.e. reducing the outer diameter and increasing the inner diameter.

With the tube 34 having an outer and inner diameter of 9 mm and 3 mm, if the recesses 34R were not present, the 3 mm uniform thickness of the cylindrical wall will be excessive such that when the tube 34 is molded to shape, mold shrinking in the direction of, or across, the thickness of the cylindrical wall would result in excessive deformation of the screw thread 35 to the extent that the tube 34 cannot be fitted or screw-engaged by the screw nut 50.

The introduction of the recesses 34R in the tube 34 creates void spaces in the tube's transverse cross-section. Such void spaces permit mold shrinking in a direction at right angles to the thickness of the cylindrical wall, thereby alleviating deformation of the screw thread 35 across the thickness such that the tube 34 can be screw-engaged by the screw nut 50. In particular, each row of teeth 35T is able to shrink laterally as permitted by presence of the recesses 34R on opposite sides, whereby the row of teeth 35T can shrink to become narrower without significantly sinking the teeth 35T (i.e. getting too much thinner) so as to maintain the teeth 35T for screw-engagement by the screw nut 50.

Looking at a different angle, the thickness of the cylindrical wall of the tube 34 can be increased by presence of the recesses 34R in the tube 34 without increasing the amount of the moldable material used in making of the tube 34. By increasing the thickness of the cylindrical wall inwardly, the passage 34P through the tube 34 can be made narrower to the 3 mm diameter for optimally fitting the pull chain 37, yet maintaining the tube's outer diameter of 9 mm and without using more molding material. This results in saving of material and hence, or also, lessening of the problem caused by mold shrinking during production.

Figure 6:
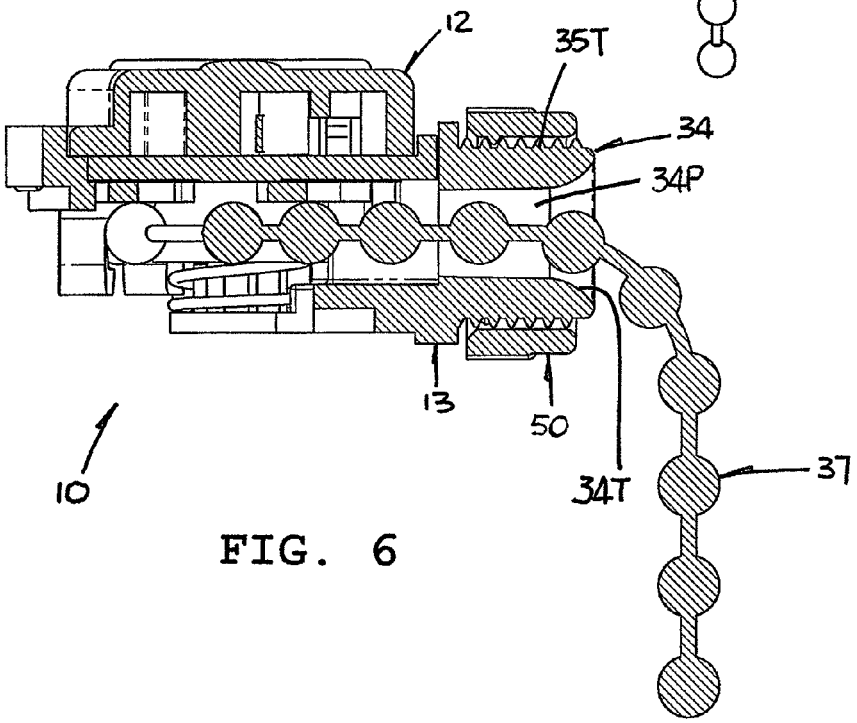
FIG. 6 is a cross-sectional side view of the electrical switch of FIG. 5 without the cover, showing the pull chain extending out from inside the electrical switch through a tubular part of a body thereof.

The tube 34 has an integral outer free end of a trumpet-shaped inner profile 34T to provide a smooth bearing for the pull chain 37 extending out of the passage 34P, as best illustrated in FIG. 6. The equivalent trumpet-shaped profile is traditionally provided by the screw nut, but this requires the metal screw nut to be relatively larger and hence makes it more costly to make.

The invention has been given by way of example only, and various modifications of and/or alterations to the described embodiment may be made by persons skilled in the art without departing from the scope of the invention as specified in the appended claims.

The invention claimed is:

1. An electrical switch comprising:

a casing having an internal volume;

at least one fixed contact and at least one moving contact located within the internal volume of the casing; and an operator supported within the internal volume of the casing for movement that moves the at least one moving contact into contact with and out of contact with the at least one fixed contact, wherein the operator includes a connector for connecting an elongate pliable member to the operator, the casing includes first and second openings for respective insertion of first and second electrical conductors in electrical communication with the at least one fixed contact and the at least one moving contact, the first and second electrical conductors being electrically connected to each other and electrically disconnected from each other by operation of the operator, the casing includes a third opening comprising a tubular passage for passage of the elongate pliable member, and the casing includes a fourth opening exposing the connector so that the elongate pliable member can be inserted through the fourth opening and a first end of the elongate pliable member engaged with the connector of the operator, and a second end of the elongate pliable member extended through the third opening so that the second end of the elongate pliable member is accessible outside the casing, and pulling of the second end of the elongate pliable member away from the casing operates the operator and moves the moving contact, electrically connecting and disconnecting the first and second electrical conductors upon alternating operations of the operator.

2. The electrical switch as claimed in claim 1, wherein the connector has a first and second ends, a cavity extending between the first and second ends and open at one side of the connector for receiving the elongate pliable member, thereby connecting the operator to the elongate pliable member.

3. The electrical switch as claimed in claim 2, wherein the connector includes a recess for retaining the elongate pliable member in the connector.

4. The electrical switch as claimed in claim 1, wherein the casing includes a closure member mountable on the casing and closing the fourth opening when mounted on the casing.

5. The electrical switch as claimed in claim 4, wherein the closure member is securable on the casing at the fourth opening through snap connection with the casing.

6. The electrical switch as claimed in claim 4, wherein the closure member includes a generally planar wall and a peripheral side wall extending from and generally transverse to the planar wall, the peripheral wall at least partially surrounding the casing and covering the fourth opening when the closure member is mounted on the casing.

7. The electrical switch as claimed in claim 1, wherein the casing has first and second parts that are interconnected with each other and defining the internal volume of the casing, the fourth opening is located in the second part, and the electrical switch further includes a third part disposable upon and covering the second part, closing the fourth opening.

8. The electrical switch as claimed in claim 7, wherein the second and third parts of the casing have comparable sizes and complementary shapes.

9. The electrical switch as claimed in claim 1, wherein the casing has an externally threaded tubular part, the elongate pliable member, when connected with the connector, extends from the casing through the tubular part for pulling, to operate the operator, and the electrical switch further includes an internally threaded nut engaging the externally threaded tubular part for mounting of the switch.

10. An electrical switch comprising:

a casing;

at least one fixed contact and at least one moving contact in the casing;

an operator supported in the casing for movement to move the moving contact into and out of contact with the fixed contact for switching; and an elongate pliable member associated with the operator and operating the operator upon being pulled, wherein the casing has a protruding tubular part by which the electrical switch may be mounted and through which the pliable member extends from the casing for pulling, and the tubular part is molded, has an inner surface defining a passage for the pliable member, an outer surface bearing a screw thread for engagement by a threaded nut member, and, in a transverse cross-section, at least one void space between the inner surface and the outer surface, alleviating deformation of the screw thread due to shrinkage of the tubular part.

11. The electrical switch as claimed in claim 10, wherein the tubular part has a wall thickness, between the inner surface and the outer surface, the wall thickness being increased by presence of the at least one void space, without increasing the amount of material used in molding the tubular part.

12. The electrical switch as claimed in claim 10, wherein the tubular part has a plurality of the void spaces disposed around the passage.

13. The electrical switch as claimed in claim 12, wherein the void spaces are of equal shape and size and are disposed evenly around the passage.

14. The electrical switch as claimed in claim 10, wherein the at least one void space opens at the outer surface and thereby interrupts the screw thread.

15. The electrical switch as claimed in claim 14, wherein the at least one void space does not reach the inner surface.

16. The electrical switch as claimed in claim 14, wherein the tubular part has a plurality of the void spaces disposed around the passage, the void spaces extending lengthwise of the tubular part as a row of teeth on the outer surface, a tooth being defined between each pair of adjacent void spaces, the teeth, across the rows, constituting the screw thread that is interrupted.

17. The electrical switch as claimed in claim 16, wherein the void spaces and the rows of teeth extend axially along the tubular part.

18. The electrical switch as claimed in claim 10, wherein the tubular part has an integral outer end with a trumpet-shaped inner profile, providing a smooth bearing for the pliable member extending from the passage.

19. The electrical switch as claimed in claim 1, further comprising the elongate pliable member.

20. The electrical switch as claimed in claim 18, wherein the elongate pliable member is a beaded strand having at least one bead and a string extending from the bead.

21. The electrical switch as claimed in claim 19, wherein the elongate member is a beaded chain including a plurality of beads connected by intervening links, and the connector includes opposed first and second ends, a cavity extending between the first and second ends and an open side through which a link of the beaded chain is laterally insertable into the cavity, and a recess within the cavity for receiving a first bead of the beaded chain and for retaining the beaded chain in the cavity of the connector, wherein the second end is spaced from the recess to engage a second bead of the beaded chain, with the link connecting the first and second beads in the cavity.

* * * * *